US009152128B2

(12) United States Patent
Marechal et al.

(10) Patent No.: US 9,152,128 B2
(45) Date of Patent: Oct. 6, 2015

(54) ESCAPEMENT MECHANISM FOR A WATCH MOVEMENT

(71) Applicant: Montres Breguet SA, L'Abbaye (CH)

(72) Inventors: Sylvain Marechal, Bois d'Amont (FR); Stephane Beugin, Les Rousses (FR); Nakis Karapatis, Premier (CH); Benoit Junod, Les Rousses (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/487,589

(22) Filed: Sep. 16, 2014

(65) Prior Publication Data

US 2015/0103637 A1 Apr. 16, 2015

(30) Foreign Application Priority Data

Oct. 16, 2013 (EP) ..... 13188953

(51) Int. Cl.
*G04B 15/08* (2006.01)
*G04B 15/14* (2006.01)

(52) U.S. Cl.
CPC ..... *G04B 15/08* (2013.01); *G04B 15/14* (2013.01)

(58) Field of Classification Search
CPC ..... G04B 15/00; G04B 15/06; G04B 15/08; G04B 15/14
See application file for complete search history.

(56) References Cited

U.S. PATENT DOCUMENTS

| | | | | |
|---|---|---|---|---|
| 581,535 | A * | 4/1897 | Church | 368/133 |
| 4,041,693 | A * | 8/1977 | Bonsack | 368/124 |
| 2002/0114225 | A1* | 8/2002 | Damasko | 368/125 |
| 2009/0168611 | A1* | 7/2009 | Gigandet et al. | 368/130 |
| 2012/0120774 | A1* | 5/2012 | Fujieda | 368/131 |
| 2012/0307601 | A1 | 12/2012 | Kruttli | |

FOREIGN PATENT DOCUMENTS

| | | |
|---|---|---|
| CH | 264 358 | 10/1949 |
| DE | 1 523 856 | 11/1969 |
| WO | WO 2011/121432 A1 | 10/2011 |

OTHER PUBLICATIONS

European Search Report issued Apr. 11, 2014 in European Application 13188953, filed on Oct. 16, 2013 ( with English Translation).

* cited by examiner

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

Escapement mechanism (3) for a watch movement including a pallet lever (7) with a fork (13) and a roller device (4) with an impulse-pin coupled to a balance (2). The fork includes an entry horn (19) and an exit horn (21), the impulse-pin including a first cam portion (12*a*, 12*b*) configured to engage the entry horn, and a second cam portion (14*a*, 14*b*) configured to engage the exit horn. The first cam portion includes a first cam surface (12*a*) configured to engage the entry horn on a first level (10*a*, 10*b*), and the second cam portion includes a second cam surface (14*b*) configured to engage the exit horn on a second level (10*b*, 13*b*), the first and second levels being staggered in a direction parallel to the axis of rotation (A) of the roller device.

22 Claims, 3 Drawing Sheets

ESCAPEMENT MECHANISM FOR A WATCH MOVEMENT

This application claims priority from European Patent Application No. 13188953.7 filed 16.10.2013, the entire disclosure of which is incorporated herein by reference.

FIELD OF THE INVENTION

The present invention concerns an escapement mechanism for a watch movement, particularly a Swiss lever or English lever escapement. The invention more particularly concerns the optimisation of the assembly formed by the impulse pin and the pallet fork.

BACKGROUND OF THE INVENTION

The assembly formed by the impulse pin and the pallet fork permits the unlocking of a tooth of the wheel of the escapement mechanism from the lever and the impulse of the balance wheel. During the impulse, the impulse pin, which is connected to the balance, and the pallet fork transmit the energy from the pallet lever to the balance with each vibration.

A conventional system is formed of a circular or "half-moon" pin with a portion of the circle removed to allow the pin to enter inside the fork in a sufficiently secure manner. The fork takes the form of a rectangular notch. The surfaces of contact with the impulse pin are generally flat.

Typically, the contact surfaces between the fork and the impulse pin are identical for unlocking and for the impulse, that is to say that the pair of surfaces in contact when unlocking occurs in the first vibration is identical to the pair of surfaces in contact when the impulse occurs in the second vibration. However, a geometry which might be optimal for the unlocking function, might not be optimal for the impulse function. In conventional systems, the geometry of the impulse pin and the fork is therefore not optimised. The aim of optimising the geometry of the contact surfaces between the impulse pin and the fork, in particular, is to reduce friction in order to reduce the wear of parts, or to reduce energy losses to increase the efficiency of the escapement.

It is an object of the invention to provide a watch escapement mechanism which is accurate and reliable over a long period of use.

It is advantageous to provide a watch escapement mechanism with very low wear.

It is advantageous to provide a watch escapement mechanism with very low power consumption.

It is advantageous to provide a compact and robust escapement mechanism.

SUMMARY OF THE INVENTION

Objects of the invention are achieved by a watch escapement mechanism according to claim 1. The dependent claims describe the advantageous aspects of the invention.

In the present invention, a watch escapement mechanism for a watch movement includes a pallet lever with a fork and a roller device with an impulse pin coupled to a balance wheel, the fork including a first horn and a second horn. The impulse pin includes a first cam portion configured to engage the first horn, and a second cam portion configured to engage the second horn. The first cam portion includes a first cam surface configured to engage the first horn on a first level of the impulse pin, and the second cam portion includes a second cam surface configured to engage the second horn on a second level of the impulse pin. The first and second levels are staggered in a parallel direction to the axis of rotation (A) of the roller device.

According to a preferred embodiment, in one direction of rotation of the balance, the first horn operates as the entry horn and the second horn as the exit horn, and in the opposite direction, the first horn operates as the exit horn and the second horn as the entry horn. However, the invention also extends to escapement mechanism having only one unlocking and impulse per return cycle of the balance, and in that case one of the horns operates only as the entry horn and the other only as the exit horn.

The first cam surface of the first cam portion may advantageously have a different, non-symmetrical geometric profile from said second cam surface of the second cam portion. This makes it possible to optimise the geometric profiles of the surfaces for the unlocking and impulse functions in order to eliminate or minimise the friction between the impulse pin and fork.

In an embodiment where the unlocking and impulse of the pallet-stones occur in both directions of rotation of the roller device, i.e. with each vibration of the balance wheel, the first cam portion further includes a second cam surface configured to engage the first horn on said second level, and the second cam portion further includes a first cam surface configured to engage the second horn on said first level. In that case, the engagement surfaces of the fork entering into contact with the impulse pin may also be symmetrical with respect to a median plane of the fork.

The second cam surface of the first cam portion may also advantageously have a different, non-symmetrical profile from said first cam surface of the second cam portion for the aforementioned reasons.

The cam surfaces on one side of the impulse pin may be symmetrical to the cam surfaces on the other side of the pin to achieve an identical engagement between the pin and the fork in both directions of rotation of the balance.

In one embodiment, the first horn includes a first engagement surface configured to engage the first cam surface of the first cam portion, and the second horn includes a second engagement surface configured to engage the second cam surface of the second cam portion, said first engagement surface having a different, non-symmetrical geometric profile from said second engagement surface. The first horn may also include a second engagement surface configured to engage the second cam surface of the first cam portion, and the second horn may include a first engagement surface configured to engage the first cam surface of the second cam portion, said second engagement surface having a different, non-symmetrical geometric profile from said first engagement surface.

This makes it possible to optimise the profiles of surfaces entering into contact on the impulse pin and also on the fork on both levels to eliminate or minimise friction between these elements. It is sought to obtain a rolling motion without sliding between the parts of the pin and of the fork which enter into contact.

The first and second levels may advantageously be separated by a space, either on the pin, or on the fork, or on both, in order to increase assembly tolerances and to prevent interference between one level on the pin and the other level on the fork.

The cam surfaces and the engagement surfaces are configured so that one of the levels at least partly performs a function of unlocking a first pallet-stone, and the other level at least partly performs an impulse function on a second pallet-stone. In a variant, the level performing an unlocking function can also perform an impulse function on the second pallet-stone, subsequent to the impulse function performed by the other level. In a variant, the other level performing an impulse function can also perform an unlocking function on the first pallet-stone, subsequent to the unlocking function performed by said level performing an unlocking function. This offers more possibilities of optimising the geometric profiles of the surfaces entering into contact during the unlocking and impulse operations.

In one embodiment, the fork and the pin can advantageously be created by a deposition method such as photolithography, or by other manufacturing methods used in the semiconductor industry, from a silicon-based material (for example silicon carbide or silicon nitride) or nickel-based material (for example nickel, nickel phosphorus). This makes it possible to obtain surface profiles in complex shapes with high precision.

In an advantageous embodiment, the impulse pin includes on one of the levels, an essentially elliptical shape, this level mainly being used for the impulse function. The impulse pin may have a conventional shape on the other level, such as a half-moon shape, or other profiles according to the optimisation calculations.

In one embodiment, the ratio of reduction between the pallet lever and the balance defined by the impulse pin and the fork on the first level may advantageously be different from the ratio of reduction defined by the impulse pin and the fork on the second level. The unlocking reduction ratio is defined by the ratio of the rotation radius of the contact point of the impulse pin on the first level divided by the rotation radius of the contact point of the fork on the first level. The impulse reduction ratio is defined by the ratio of the radius of the contact point of the impulse pin on the second level divided by the rotation radius of the contact point of the fork on the second level. The unlocking reduction ratio may advantageously be smaller than the impulse reduction ratio. This configuration makes it possible to minimise the torque taken on the balance during unlocking.

In the present invention, the utilisation of a fork/pin structure organised on two levels makes it possible to have a first level dimensioned and optimised to perform the unlocking function (first and/or second vibration of the oscillation) while the second level can be dimensioned and optimised to perform the impulse function.

BRIEF DESCRIPTION OF THE DRAWINGS

Other advantageous objects and aspects of the invention will appear upon reading the claims, and the detailed description of embodiments below, and the annexed drawings, in which:

DETAILED DESCRIPTION OF THE INVENTION

Figure 1:
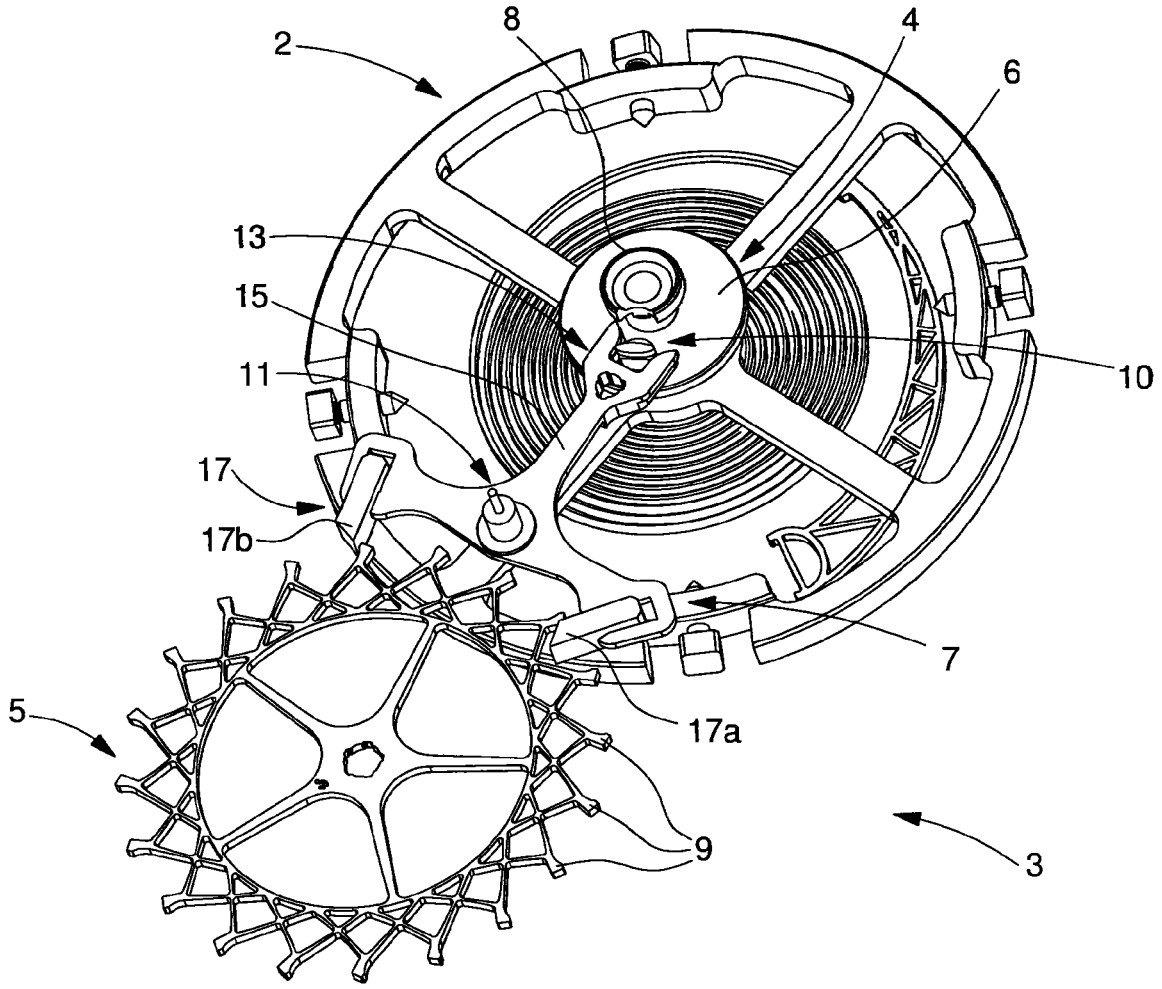
FIG. 1 is a schematic perspective view of an escapement mechanism for a watch movement, according to an embodiment of the invention.

Referring to the Figures, an escapement mechanism for a watch movement includes a wheel 5 with teeth 9, a pallet lever 7 and a roller device 4 coupled to a balance wheel 2.

The pallet lever includes a fork 13, pallet stones 17*a*, 17*b*, and a lever 15 interconnecting the pallet-stones to the fork. The lever is coupled in rotation to the frame of a movement by means of a pivot 11. The pallet-stones engage teeth 9 of the wheel which is connected to an energy source delivering a rotational torque on the wheel. One pallet-stone forms the entry pallet 17*a* and the other forms the exit pallet 7*b*. The pallet lever further includes a guard-pin (not illustrated) fixed to the fork by means, for example, of a pin driven into a securing hole 27 at the base of the fork. The mechanism illustrated corresponds to a Swiss lever type escapement. As this principle is well known, the conventional elements and the operation thereof will not be described in more detail in this description.

The roller device 4 includes a table roller 6 with an impulse pin 10 and a small roller 8 provided with a passing-hollow or notch 16 for the guard-pin. The impulse pin 10 has, on one side, a first cam portion 12 and on the other side, a second cam portion 14. In the direction of rotation of the balance illustrated in FIGS. 3*a* to 3*c* (first vibration), the first cam portion 12 operates as the entry cam and the second cam portion as the exit cam. Since the balance has an oscillating motion, in the other direction of rotation (second vibration), the functions of the first and second cam portions are reversed.

Fork 13 has a first horn 19 and a second horn 21. In the direction of rotation of the balance illustrated in FIGS. 3*a* to 3*c* (first vibration), the first horn 19 operates as the entry horn and the second horn as the exit horn. In the other direction of rotation (second vibration), the functions of the first and second horns are reversed.

Impulse pin 10 has two levels 10*a*, 10*b*, these levels being staggered in relation to each other in a direction parallel to the axis of rotation (A) of pivot 11. Fork 13, which is engaged by the impulse pin with each vibration, also includes two levels corresponding to levels 13*a*, 13*b*.

The impulse pin includes first cam surfaces 12*a*, 14*a* on a first level 10*a*, and second cam surfaces 12*b*, 14*b* on a second level 10*b*. Horns 19, 21 include first engagement surfaces 23*a*, 25*a* on first level 13*a*, and second cam surfaces 23*b* on second level 13*b*.

According to a preferable embodiment, the two levels of the impulse pin may be separated by a height h to prevent any contact between the different levels of the fork and the impulse pin. The two levels are interconnected by an interconnecting piece 10*c* integral with the two levels. According to a variant, this space may also be included in the fork, in addition to or instead of in the impulse pin.

The cam and engagement surfaces may advantageously include distinct profile geometries for the fork/impulse pin contact during the unlocking and impulse functions. According to an embodiment of the invention, one of the levels is dedicated to the unlocking function (in the illustrated example, the first level 10*a*, 13*a*) and the other level is dedicated to the impulse function (in the illustrated example, the second level 10*b*, 13*b*).

Figure 3:
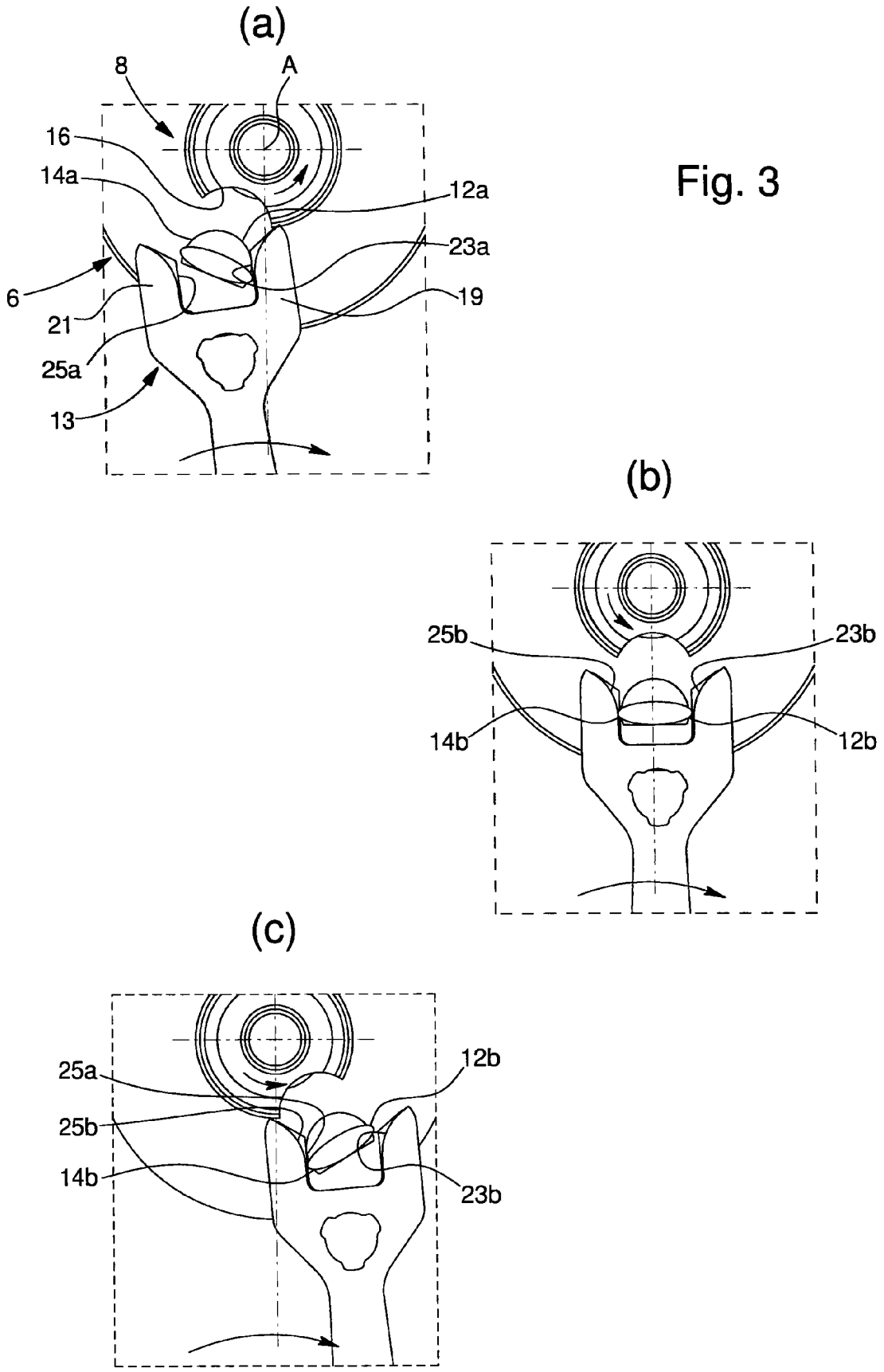
FIGS. 3*a*, 3*b* and 3*c* are views of the fork-impulse pin structure of the FIG. 2 embodiment, illustrating the escapement function during an oscillation vibration: (a) unlocking-(b) start of the impulse-(c) end of the impulse.

At the start of the unlocking function, the first levels 10*a*, 13*a* of the fork and of the impulse pin cooperate (FIG. 3*a*). The first cam surface 12*a* enters into contact with the first engagement surface 23*a* of the first horn 19. During this contact, pallet lever 7 is pushed by balance 7, which thus loses part of its energy. The contact between the two profiles occurs over a certain angle, greater than the angle necessary for the unlocking of pallet-stone 17*a* from tooth 9 of escape wheel 5 due to the dynamic geometric recoil of the gear train and the finite acceleration of the gear train wheel sets. Initially, the pallet lever is only pushed by balance 7, whereas, once unlocking has finished, the pallet lever is pushed by balance 7 and escape wheel 5, the speed of the latter not yet being sufficient to cause loss of contact between surfaces 23*a* and 19.

When the speed of the pallet lever becomes sufficiently high under the thrust of escape wheel 5, this contact is lost and, after a transient time during which there is no contact between the impulse pin and the fork, the second levels 10*b*, 13*b* of the fork and of the impulse pin enter into contact (FIG. 3*b*). The second cam surface 14*b* of the second cam portion of the impulse pin enters into contact with the second engagement surface 25*b* of second horn 21.

This contact occurs for most of the time during the impulse function. According to a variant, during the entire impulse phase, the fork-impulse pin contact occurs on second level 10*b*, 13*b*. This case is a construction providing a much shorter escape wheel impulse plane Pr than the pallet-stone impulse plane Pa: Pr<Pa/3. In this case, the impulse finishes early with respect to the locking of the fork.

Figure 2:
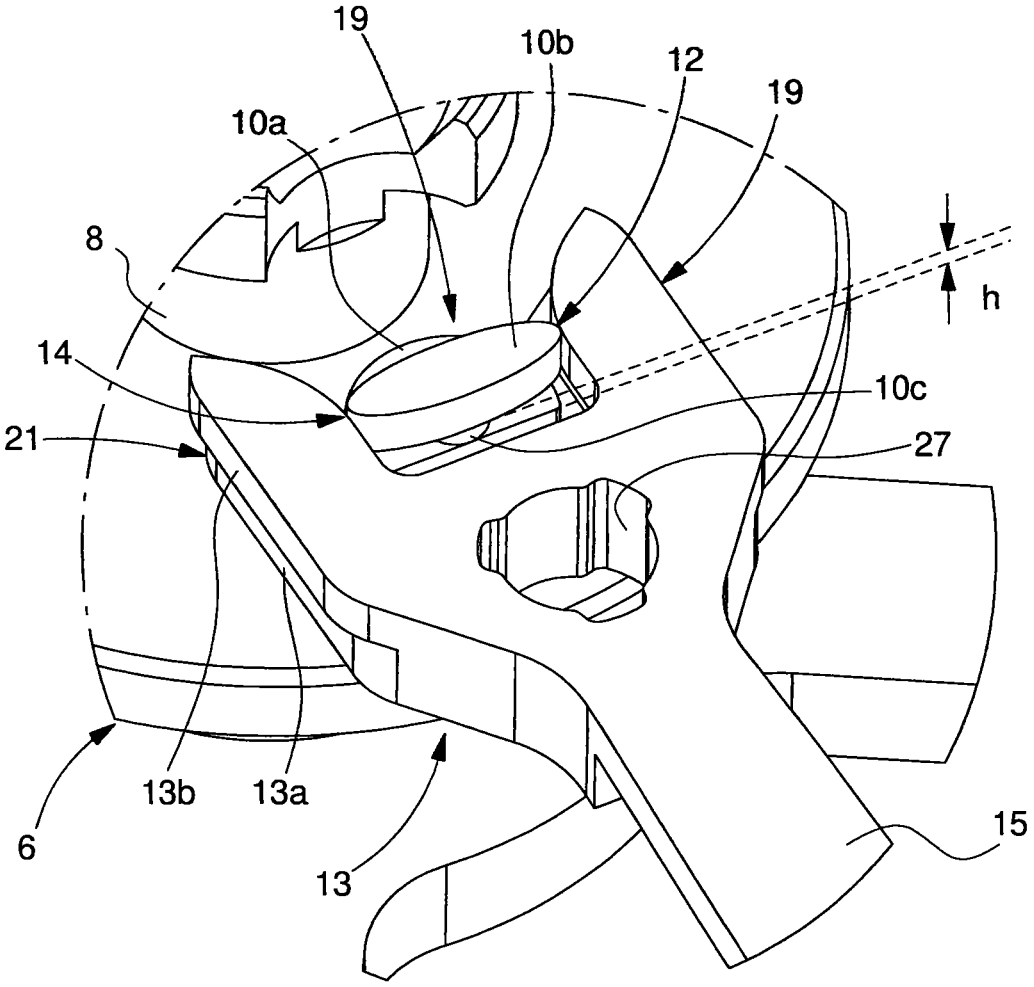
FIG. 2 is a perspective view of a fork-impulse pin structure of an escapement mechanism according to an embodiment of the invention.

According to another variant, at the end of the impulse phase, the fork-impulse pin contact occurs on the first level 10*a*, 13*a* (FIGS. 2 and 3*c*). This case is a construction providing an escape wheel impulse plane Pr comparable to or greater than the pallet-stone impulse plane Pa: Pr≥Pa/3 In this case, the impulse finishes immediately before the locking of the fork.

In an advantageous embodiment, the reduction ratio between the pallet lever and the balance defined by impulse pin 10*a* and fork 13*a* on the first level differs from the reduction ratio defined by impulse pin 10*b* and fork 13*b* on the second level. The reduction ratio of one level is a function of the rotation radius ($r_{10a}$, $r_{10b}$) of the point of contact on the impulse pin and the rotation radius of the point of contact on the fork ($r_{13a}$, $r_{13b}$), the reduction ratio being the radius of the contact point of the impulse pin divided by the radius of the contact point of the fork. The rotation radius of a point of contact on the impulse pin, respectively on the fork, means the distance between the axis of rotation of the impulse pin, respectively of the fork, and the point of contact between the impulse pin and the fork.

Preferably, the unlocking reduction radius, defined by the ratio of the rotation radius of the contact point of first level 10*a* of the impulse pin divided by the rotation radius of the contact point of the first level of fork 13*a*, is smaller than the impulse reduction ratio, defined by the ratio of the rotation radius of the contact point of impulse pin 10*b* divided by the rotation radius of the contact point of fork 13*b*. In formula: $r_{10a}/r_{13a}<r_{10b}/r_{13b}$.

This configuration advantageously minimises the torque taken on the balance during unlocking.

The utilisation of different shapes makes it possible to independently optimise the two unlocking and impulse functions:

- the reduction ratio between the two components (balance and pallet lever) can be optimised for each function
- the angle covered by the pallet lever between the end of engagement and the start of the impulse can be reduced. It is typically around 5°-10°, and it could be reduced to below 3°, which makes it possible to increase the efficiency of the escapement by 3%-5% (for example from 35% to 40%), particularly for frequencies higher than 3 Hz.
- different geometric profiles can be used on the two levels such as, for example, a gear train profile for the surfaces in contact during the impulse. The use of a specific profile for this function makes it possible to decrease the sliding distance during contact which means limits energy losses and the abrasion work on these surfaces and thus limits their risk of wear.
- specific shapes may be used to increase contact pressure which may also be advantageous in terms of efficiency (decrease in friction coefficient).

The invention may also be used in escapements of the coaxial, natural type, with English lever escapements or other known types of escapements.

The fork and/or the impulse pin may be manufactured from various materials including silicon, silicon nitride, and silicon carbide, by various manufacturing methods including deposition, photolithography and DRIE (deep reactive-ion etching) methods. The fork and/or the impulse pin may be manufactured from nickel or nickel phosphorus (NiP), for example using a LIGA manufacturing method (Röntgenlithographie, Galvanoformung, Abformung).

The invention provides several advantages:

- optimisation of the angular position during the unlocking and impulse operations
- optimisation of the reduction ratio between the pallet lever and the balance for the unlocking and impulse functions
- reduction in the angle to be made up by the pallet-stone between the end of unlocking and the start of the impulse
- decrease in the risk of wear of the fork/impulse contact surfaces responsible for the impulse
- possibility of increasing pressure contact for one of the two functions and of decreasing the friction coefficient (and thus increasing the efficiency of the escapement)
- possibility of simultaneously increasing the torque available for the pallet lever and the angular interval of the impulse (and thus the energy transmitted to the movement) without increasing the risk of breakage/wear.

LIST OF REFERENCES

Balance 2
Escapement mechanism 3
A wheel 5
Tooth 9
Pallet lever 7
Pivot 11
Fork 13
First horn 19 (entry horn)
First engagement surface 23*a* (first level 13*a*)
Second engagement surface 23*b* (second level 13*b*)
Second horn 21 (exit horn)
First engagement surface 25*a* (first level 13*a*)
Second engagement surface 25*b* (second level 13*b*)
Securing element (hole) for guard pin 27
Lever 15
Pallet-stones 17
Entry pallet 17*a*
Exit pallet 17*b*
Locking face
Impulse face
Roller device 4
Table roller 6
Impulse pin 10
First cam portion 12 (entry cam)
First cam surface 12*a* (first level 10*a*)
Second cam surface 12*b* (second level 10*b*)
Piece for interconnecting levels 23*c*
Second cam portion 14 (exit cam)
First cam surface 14*a* (first level 10*a*)
Second cam portion 14*b* (second level 10*b*)
Small roller 8
Passing hollow or notch 16

What is claimed is:

1. An escapement mechanism for a watch movement including a pallet lever with a pallet fork and a roller device with an impulse pin coupled to a balance wheel, the fork including a first horn and a second horn, the impulse pin including a first cam portion configured to engage the first horn, and a second cam portion configured to engage the second horn, wherein the first cam portion includes a first cam surface configured to engage the first horn on a first level and the second cam portion includes a second cam surface configured to engage the second horn on a second level, the first and second levels being staggered in a direction parallel to the axis of rotation of the roller device.

2. The escapement mechanism according to claim 1, wherein said first cam surface of the first cam portion has a different, non-symmetrical geometric profile from said second cam surface of the second cam portion.

3. The escapement mechanism according to claim 1, wherein the first cam portion includes a second cam surface configured to engage the first horn on said second level, and the second cam portion includes a first cam surface configured to engage the second horn on said first level.

4. The escapement mechanism according to claim 3, wherein said second cam surface of the first cam portion has a different, non-symmetrical profile from said first cam surface of the second cam portion.

5. The escapement mechanism according to claim 3, wherein the first cam surface of the first cam portion is symmetrical to the first cam surface of the second cam portion, and the second cam surface of the first cam portion is symmetrical to the second cam surface of the second cam portion.

6. The escapement mechanism according to claim 1, wherein the first horn includes a first engagement surface configured to engage the first cam surface of the first cam portion, and the second horn includes a second engagement surface configured to engage the second cam surface of the second cam portion, said first engagement surface having a different, non-symmetrical geometric profile from said second engagement surface.

7. The escapement mechanism according to claim 6, wherein the first horn includes a second engagement surface configured to engage a second cam surface of the first cam portion, and the second horn includes a first engagement surface configured to engage a first cam surface of the second cam portion, said second engagement surface having a different, non-symmetrical geometric profile from said first engagement surface.

8. The escapement mechanism according to claim 7, wherein the first engagement surface of the first horn is symmetrical to the first engagement surface of the second horn, and the second engagement surface of the first horn is symmetrical to the second engagement surface of the second horn.

9. The escapement mechanism according to claim 1, wherein the first and second levels are separated by a space.

10. The escapement mechanism according to claim 1, wherein the cam surfaces and engagement surfaces are configured so that one of the levels at least partly performs a function of unlocking a first pallet-stone, and the other level at least partly performs an impulse function on a second pallet-stone.

11. The escapement mechanism according to claim 10, wherein the cam surfaces and the engagement surfaces are configured so that the level performing an unlocking function also performs an impulse function on the second pallet-stone subsequent to the impulse function performed by the other level.

12. The escapement mechanism according to claim 10, wherein the cam surfaces and the engagement surfaces are configured so that said other level performing an impulse function also performs an unlocking function on the first pallet-stone subsequent to the unlocking function performed by said level performing an unlocking function.

13. The escapement mechanism according to claim 1, wherein the fork and the impulse pin are made of a silicon-based material.

14. The escapement mechanism according to claim 1, wherein the fork and the impulse pin are made of a material derived from silicon.

15. The escapement mechanism according to claim 1, wherein the fork and the impulse-pin are made by a photolithography method.

16. The escapement mechanism according to claim 1, wherein the fork and the impulse-pin are made of a nickel-based material.

17. The escapement mechanism according to claim 1, wherein the fork and the impulse-pin are obtained from a LIGA method.

18. The escapement mechanism according to claim 1, wherein the first cam portion and/or the second cam portion of the impulse-pin includes a gear train profile.

19. The escapement mechanism according to claim 1, wherein the second level of the impulse-pin has an essentially elliptical shape.

20. The escapement mechanism according to claim 1, wherein a reduction ratio between the pallet lever and the balance wheel defined by the impulse-pin and the fork on the first level differs from a reduction ratio defined by the impulse-pin and the fork on the second level.

21. The mechanism according to claim 20, wherein an unlocking reduction ratio, defined by the ratio of rotation radius of a contact point of the first level of the impulse pin divided by the rotation radius of a contact point of the first level of the fork, is smaller than an impulse reduction ratio, defined by the ratio of the rotation radius of a contact point of the impulse pin divided by the rotation radius of a contact point of the fork.

22. A watch movement including an escapement mechanism including a pallet lever with a pallet fork and a roller device with an impulse pin coupled to a balance wheel, the fork including a first horn and a second horn, the impulse pin including a first cam portion configured to engage the first horn, and a second cam portion configured to engage the second horn, wherein the first cam portion includes a first cam surface configured to engage the first horn on a first level and the second cam portion includes a second cam surface configured to engage the second horn on a second level, the first and second levels being staggered in a direction parallel to the axis of rotation of the roller device.

* * * * *